US007730970B2

(12) United States Patent
Fincher et al.

(10) Patent No.: US 7,730,970 B2
(45) **Date of Patent: *Jun. 8, 2010**

(54) DRILLING EFFICIENCY THROUGH BENEFICIAL MANAGEMENT OF ROCK STRESS LEVELS VIA CONTROLLED OSCILLATIONS OF SUBTERRANEAN CUTTING LEVELS

(75) Inventors: Roger W. Fincher, Conroe, TX (US); Larry A. Watkins, Houston, TX (US); Peter Aronstam, Houston, TX (US); Allen Sinor, Conroe, TX (US); John L. Baugh, College Station, TX (US)

(73) Assignee: Baker Hughes Incorporated, Houston, TX (US)

( * ) Notice: Subject to any disclaimer, the term of this patent is extended or adjusted under 35 U.S.C. 154(b) by 45 days.

This patent is subject to a terminal disclaimer.

(21) Appl. No.: 11/851,183

(22) Filed: Sep. 6, 2007

(65) Prior Publication Data

US 2007/0295537 A1 Dec. 27, 2007

Related U.S. Application Data

(63) Continuation of application No. 11/038,889, filed on Jan. 20, 2005, now Pat. No. 7,341,116.

(51) Int. Cl.
*E21B 7/24* (2006.01)

(52) U.S. Cl. ..... 175/56; 175/57; 175/381; 173/4

(58) Field of Classification Search ..... 175/56, 175/57, 381, 299, 322, 189; 173/2, 4, 11
See application file for complete search history.

(56) References Cited

U.S. PATENT DOCUMENTS 4,261,425 A 4/1981 Bodine (Continued)

FOREIGN PATENT DOCUMENTS

EP 14042 A1 * 8/1980

(Continued)

OTHER PUBLICATIONS

Zelinski, Peter, "The Dynamics of Better Drilling", Mar. 20, 2003, MMS online as http://www.mmsonline.com/articles/060101.html.*

(Continued)

*Primary Examiner*—David J Bagnell
*Assistant Examiner*—David Andrews
(74) *Attorney, Agent, or Firm*—Madan & Sriram, P.C.

(57) ABSTRACT

A device and system for improving efficiency of subterranean cutting elements uses a controlled oscillation super imposed on steady drill bit rotation to maintain a selected rock fracture level. In one aspect, a selected oscillation is applied to the cutting element so that at least some of the stress energy stored in an earthen formation is maintained after fracture of the rock is initiated. Thus, this maintained stress energy can thereafter be used for further crack propagation. In one embodiment, an oscillation device positioned adjacent to the drill bit provides the oscillation. A control unit can be used to operate the oscillation device at a selected oscillation. In one arrangement, the control unit performs a frequency sweep to determine an oscillation that optimizes the cutting action of the drill bit and configures the oscillation device accordingly. One or more sensors connected to the control unit measure parameters used in this determination.

22 Claims, 5 Drawing Sheets

U.S. PATENT DOCUMENTS

| | | | | |
|---|---|---|---|---|
| 4,266,171 | A | 5/1981 | Mashimo | |
| 4,815,328 | A | 3/1989 | Bodine | |
| 5,158,109 | A | 10/1992 | Hare, Sr. | |
| 5,220,963 | A | 6/1993 | Patton | |
| 5,341,886 | A | 8/1994 | Patton | |
| 5,419,405 | A | 5/1995 | Patton | |
| 5,562,169 | A | 10/1996 | Barrow | |
| 5,595,254 | A | 1/1997 | Tibbitts | |
| 5,671,816 | A | 9/1997 | Tibbitts | |
| 5,947,214 | A | 9/1999 | Tibbitts | |
| 6,092,610 | A | 7/2000 | Kosmala | |
| 6,182,774 | B1 | 2/2001 | Tibbits | |
| 6,192,998 | B1 | 2/2001 | Pinckard | |
| 6,227,044 | B1 | 5/2001 | Jarvis | |
| 6,233,524 | B1 * | 5/2001 | Harrell et al. | 702/9 |
| 6,257,356 | B1 | 7/2001 | Wassell | |
| 6,308,940 | B1 | 10/2001 | Anderson | |
| 6,325,163 | B2 | 12/2001 | Tibbitts | |
| 6,338,390 | B1 * | 1/2002 | Tibbitts | 175/56 |
| 6,357,538 | B2 | 3/2002 | Tibbitts | |
| 6,424,079 | B1 | 7/2002 | Carroll | |
| 6,445,012 | B2 | 9/2002 | Takahashi et al. | |
| 6,568,470 | B2 | 5/2003 | Goodson et al. | |
| 6,594,881 | B2 | 7/2003 | Tibbits | |
| 6,648,081 | B2 | 11/2003 | Fincher et al. | |
| 6,997,271 | B2 | 2/2006 | Nichols et al. | |
| 2002/0011358 | A1 | 1/2002 | Wassell | |
| 2002/0088648 | A1 | 7/2002 | Krueger et al. | |
| 2005/0024232 | A1 | 2/2005 | Gardner et al. | |

FOREIGN PATENT DOCUMENTS

| | | |
|---|---|---|
| GB | 2050466 | 1/1981 |
| GB | 2352464 | 1/2001 |

OTHER PUBLICATIONS

UILD; United Diamond.
The Dynamics of Better Drilling: Feature Article; MMS Online; Peter Zelinski; http://www.mmsonline.com/articles/060101.htm.
United Diamond; Torque Buster.
Novatek; Rotary Percussion Drill Bit; http://www,novatekonline.com/phast.html.
United Diamond; Experience; Precision Drilling.
Precision Drilling; Innovative Development; Strategic Deployment; 2002 Annual Report.

* cited by examiner

DRILLING EFFICIENCY THROUGH BENEFICIAL MANAGEMENT OF ROCK STRESS LEVELS VIA CONTROLLED OSCILLATIONS OF SUBTERRANEAN CUTTING LEVELS

CROSS-REFERENCE TO RELATED APPLICATIONS

This application is a continuation of U.S. patent application Ser. No. 11/038,889 filed Jan. 20, 2005.

BACKGROUND OF THE INVENTION

1. Field of the Invention

In one aspect, this invention relates generally to systems and methods for controlling the behavior or motion of one or more cutting elements to optimize the cutting action of the cutting element(s) against an earthen formation.

2. Description of Related Art

To obtain hydrocarbons such as oil and gas, boreholes are drilled by rotating a drill bit attached at a drill string end. Conventionally, the drill bit is rotated by rotating the drill string using a rotary table at the surface and/or by using a drilling motor in a bottomhole assembly (BHA). Because wellbore drilling can be exceedingly costly, considerable inventive effort has been directed to improving the overall efficiency of the drilling activity. One conventional measure for evaluating the efficiency of drilling activity is Specific Input Energy (Se), which the drill bit industry defines as the energy required to drill a specific volume of rock in a given time period, i.e. the input energy required to achieve a target ROP.

Generally speaking, drilling efficiency has not changed substantially since industry was capable of estimating or measuring Se. The Se required to drill a volume of rock is strongly influenced by the chip or cutting size generated at the face of the bit. In general Se increases and drilling efficiency declines as cuttings become progressively smaller. This relationship is driven by the amount of energy required to remove a given volume of rock from the parent rock. One can better understand this relationship by thinking of table salt grains vs. kidney beans. For a given volume within a container, more salt grains will be present than beans. It is also evident that more of total volume is contained in fewer beans than salt grains. If one takes a drill cutting the size of the bean and continues to reduce its size until all of its volume is in particles the size of salt grains, it is clear that addition energy has been required. For further illustration, consider a borehole drilled to produce an extremely thin kerf. This could be thought of as a core that is practically the diameter of the final drilled hole. Of course this has practical limits, but does tend to define the largest possible cutting and the minimum amount of energy used to break the core into smaller pieces. In this case drilling efficiency would be maximized from a drill cutting surface to a contained volume standpoint. Said differently, one wants to maximize cutting size and keep the surface area of the cuttings to a minimum; i.e., the cuttings volume to cuttings surface area ratio should be as large as possible.

Herein is the classic method of improving drilling efficiency or reducing Se. The bigger the cutting, the less work done on the undisturbed volume within the cutting. Thus, attempts have been made to increase cutting size to a practical maximum by through design of drill bits and, to some degree, BHA's. Conventional drill bits are provided with a number of cutting elements or cutters on their face. Increased cutting size can be achieved by increasing cutter size, depth of cut, and by increasing bit torque as long as the increased torque produces larger cuttings. There are practical limits to these methods and only limited change to average cutting size has occurred in the past 10 or 15 years.

The present invention address these and other needs relating to the efficiency of drill bit.

SUMMARY OF THE INVENTION

The present invention provides systems, methods and devices for controlling the behavior of a drill bit to optimize the cutting action of the drill bit vis-à-vis the drilled formation. For example, a controlled oscillation is applied to the drill bit so that once a rock crack or fracture at the cutter/rock face interface has begun, it can be maintained so that crack restart energy (stress) is not lost at fracture. Thus, this restart energy does not have to be added back to that rock structure before the crack further propagates. In one embodiment of the present invention, a controlled torsional force is momentarily superimposed on a constant drill bit rotation in a manner that maintains a substantially average bit rotation speed. The torsional force temporarily accelerates the cutting elements of the drill bit to at least maintain contact with a fracturing earthen formation and thereby maintain the cutting element and rock surface interface stress level. Thus, the cutting element and rock surface interface experiences a significantly lower loss of stored stress energy and the remaining stored stress energy can be used to initiate the subsequent rock fracture.

In an exemplary arrangement, a drilling system includes a conventional surface rig that conveys a drill string and a bottomhole assembly (BHA) into a wellbore in a conventional manner. The system also includes a plurality of sensors for measuring one or more parameters of interest, an oscillation device for oscillating a drill bit in the BHA, and a control unit for operating the oscillation device. The control unit uses the sensor measurement to determine parameters such as the frequency and amplitude of the oscillations that optimizes the drill bit cutting action (or the "optimizing oscillation"). In one embodiment, the oscillation device controls behavior of the drill bit by allowing only selected vibration or vibrations in the drill string and/or BHA to reach the drill bit. In such an arrangement, the oscillation device can be a largely passive device (i.e., not require energy input). In another embodiment, the oscillation device includes a drive unit that amplifies a selected frequency and/or shifts an existing frequency to a selected frequency. In yet other embodiments, the oscillation device is positioned proximate to the drill bit to create a force or forces that produce a selected drill bit oscillation. In still other embodiments, the oscillation device is configured to provide a pre-determined oscillation (e.g., a torsional oscillation at a selected frequency and amplitude) or range of oscillations and, therefore, is not controlled by a control unit. The configuration of such an oscillation device can be based on historical performance data for the drill bit, BHA, drill string as well as formation data collected from the well or an offset well.

In other aspects, the teachings of the present invention can be advantageously applied to increase the efficiency of various types of cutters used in drilling and completing operations. For example, the efficiency of cutters such as underreamers and hole openers can also be improved by the present teachings.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE INVENTION

Figure 1:
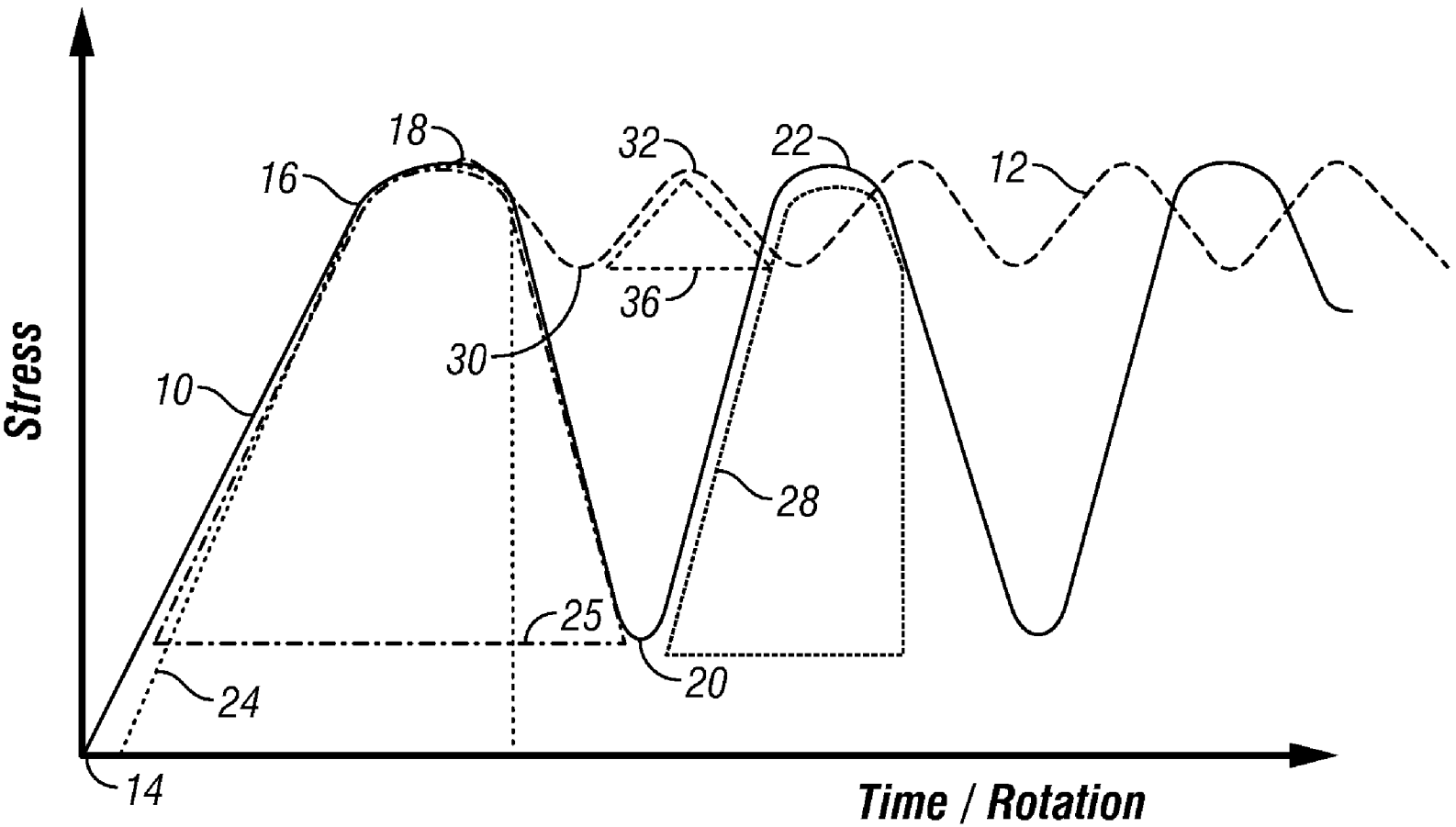
FIG. 1 graphically illustrates the relationship between stress levels and the effectiveness of a drill bit in fracturing a rock.

The teachings of the present invention can be applied in a number of arrangements to generally improve drilling efficiency. Such improvements may include improvement in ROP without increasing work done, improved bit and cutter life (e.g., as defined by volume drilling relative to wear), a reduction in waste energy (typically heat and vibration), reduction in wear and tear on BHA, and an improvement in bore hole quality. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

As will be seen in more detail below, the inventors have perceived that a major component in the energy balance of drilling is the amount of cyclic elastic or stored energy that is added and then released as drill-cutting chips are produced by the drill bit. In most brittle or semi brittle materials, elastic strain (deformation) occurs before a fracture, crack or tear can occur. This stored energy is required to reach the point of fracture. If the fracture releases stress at a rate greater than the rate additional stress is added, then generally speaking, the fracture will self-arrest and chip size will likely be defined. The energy released during fracture is 'lost' and must be added again before the fracture will continue to grow.

Embodiments of the present invention control the behavior of a drill bit in order to minimize the loss of stored stress energy and thereby maximize the cutting action of the drill bit against a rock formation. In one arrangement, an torsional oscillation applied to the drill bit enables the drill bit's cutting elements to maintain a stress at the cutter/rock face interface at a level that minimizes the loss of stress energy. Because this energy is not lost, the energy needed for further rock fracturing does not have to be added back to that rock formation. The frequency and amplitude of this torsional oscillation can be controlled to initiate, maintain and/or optimize this action. It should be understood, however, that the principles described above can be utilized with axial oscillations, lateral oscillations, and loadings having two or more components. Merely for convenience, a torsion oscillation is described below.

Referring initially to FIG. 1, there is shown a graph that illustrates some of the teachings of the present invention. The ordinate is a dimensionless stress unit and the abscissa is time or drill bit rotation. The behavior of a conventional drill bit is shown with solid line 10 and the behavior of a drill bit controlled according to embodiment of the present invention is shown with dashed line 12. Conventionally, a rotary power device such as a drill string and/or drilling motor rotates the drill bit at a substantially constant rotational speed. Upon start of rotation, point 14 is a time at which a cutting element of the drill bit initially engages a rock surface. Rotation of the drill bit creates a stress build up at the interface between the cutting element and the rock surface until at point 16 where the rock reaches the end of the elastic region and is forced to fail in a brittle fracture mode. Additional stress build-up beyond the elastic region ultimately causes a fracture of the rock at point 18. Conventionally, at the point of fracture, the cutting element and rock interface experiences a rapid stress energy release that, in large measure, is caused by the failure of the cutting element to engage the rock face with sufficient force to maintain the stress level. For example, the fracture may propagate at a speed that causes a physical separation of the cutting element and the rock. Thus, conventionally, stress energy for causing a subsequent fracture begins to build only after the cutting element re-establishes an interface with the rock at point 20. At point 20, rotation of the drill bit begins to restore the lost stress energy until the rock again fractures at point 22. Thus, it should be appreciated that for line 10, the area denoted with numeral 24 represents an initial stored stress energy for causing an initial rock fracture, the area denoted with numeral 25 represents the amount of stress energy released or lost by the initial rock fracture, and the area denoted with numeral 28 represents the amount of energy restored to cause a subsequent rock fracture.

In one embodiment of the present invention, a controlled torsional force is momentarily superimposed on the constant drill string rotation at point 18 such that the cutting element temporarily accelerates to at least maintain contact with the fracturing rock and thereby maintain the cutting element and rock surface interface stress level at least until the drill bit at its constant rotational speed can apply the cutting element and rock surface interface stress level, which is denoted as point 30. However, the controlled torsional force does not change the average bit rotation speed. Thus, point 30 represents the point at which the momentary torsional force is no longer applied to the drill bit. Stated differently, at point 18, the cutting element speeds up to stay with the fracturing rock until the drill string rotating the drill bit "catches up" at point 30. Thus, the cutting element and rock surface interface experiences a significantly lower loss of stored stress energy. This is advantageous because the remaining stored stress energy can be used to initiate the subsequent rock fracture at point 32. As can be seen, the point of subsequent fracture 32 is reached with a much lower amount of restored energy, the area denoted with numeral 36 being the restored energy.

As should be appreciated, the energy that is typically lost upon fracture arrest, as shown by area 25, is not lost because the cutter is temporarily accelerated by controlled torsional oscillations, or another type of applied oscillation, to chase the fracture and keep a fracture level stress within the rock, as shown by line 12. While line 12 is shown as sinusoidal, other cutter behavior such as that described by a sawtooth pattern may also be utilized. Further, the cyclic action need not be symmetric either in amplitude or over time. Thus, the stress required for the next fracture is not lost and is not required to be reapplied. Also, for rock-like brittle materials, it is generally accepted that the stress level required to maintain fracture growth is lower than the stress required to start the fracture. Thus, it should be further appreciated that the drill bit cuts the rock formation with lower overall energy input.

In some embodiments, the frequency of an optimum torsional oscillation may be in the range from several Hz to 200 Hz depending on the size of the drill bit. The amplitude of the oscillation will be function of the frequency, rock elastic behavior, bit speed, drill string rotary inertia and other downhole factors. The application of the oscillation will be normally uniform with forward-based acceleration maximized and return to neutral position acceleration reduced to a level that ensures that velocity of all cutters on the face of the bit remains positive, i.e., the drill bit's base line rotational position advances to the angular position of the oscillation induced forward rotation without local negative (reverse) rotation of the bit face.

It should be understood that the FIG. 1 graph is provided merely to facilitate the explanation of aspects of the present invention and does not reflect any specific quantitative relationship between rock stress, time values and rotational position or any measured behavior. Moreover, while the graph depicts a fairly stable cutting pattern, it should it understood that in practice the drill bit behavior may be more erratic. Thus, while the stored energy (stress) has been described as not being lost at fracture, it is believed that some portion will be lost at fracture. Accordingly, terms such as "optimal" or "optimizing" are intended to describe a condition of the drill bit as compared to a drill bit that is not subjected to controlled oscillations.

As should be apparent from the above-discussion, control of the cutting action of the drill bit cutting elements can be particularly relevant to improving rate-of-penetration (ROP) of a drilling assembly. As shown in FIG. 1, embodiments of the present invention can reduce the energy input required to fracture rock. Also, advantageously, there is a reduction in the time delay between arrest of a fracture and restart of a subsequent fracture. In the drilling operation, this may result in a reduction in drilling torque for a target ROP and/or an increase in ROP. That is, an energy savings is realized by a reduction in torque needed to maintain a target ROP and/or an increase in ROP (or volume or rock removal) is realized by increasing torque back to the level present before the efficiency increase. Stated differently, if a fixed energy input level can cause the fracture or crack to grow continuously, then both the required stress level can be minimized and the rock volume removed per unit time as a result of the induced fractures can be maximized. This leads to an increase in ROP and an improvement in drilling efficiency.

Figure 2:
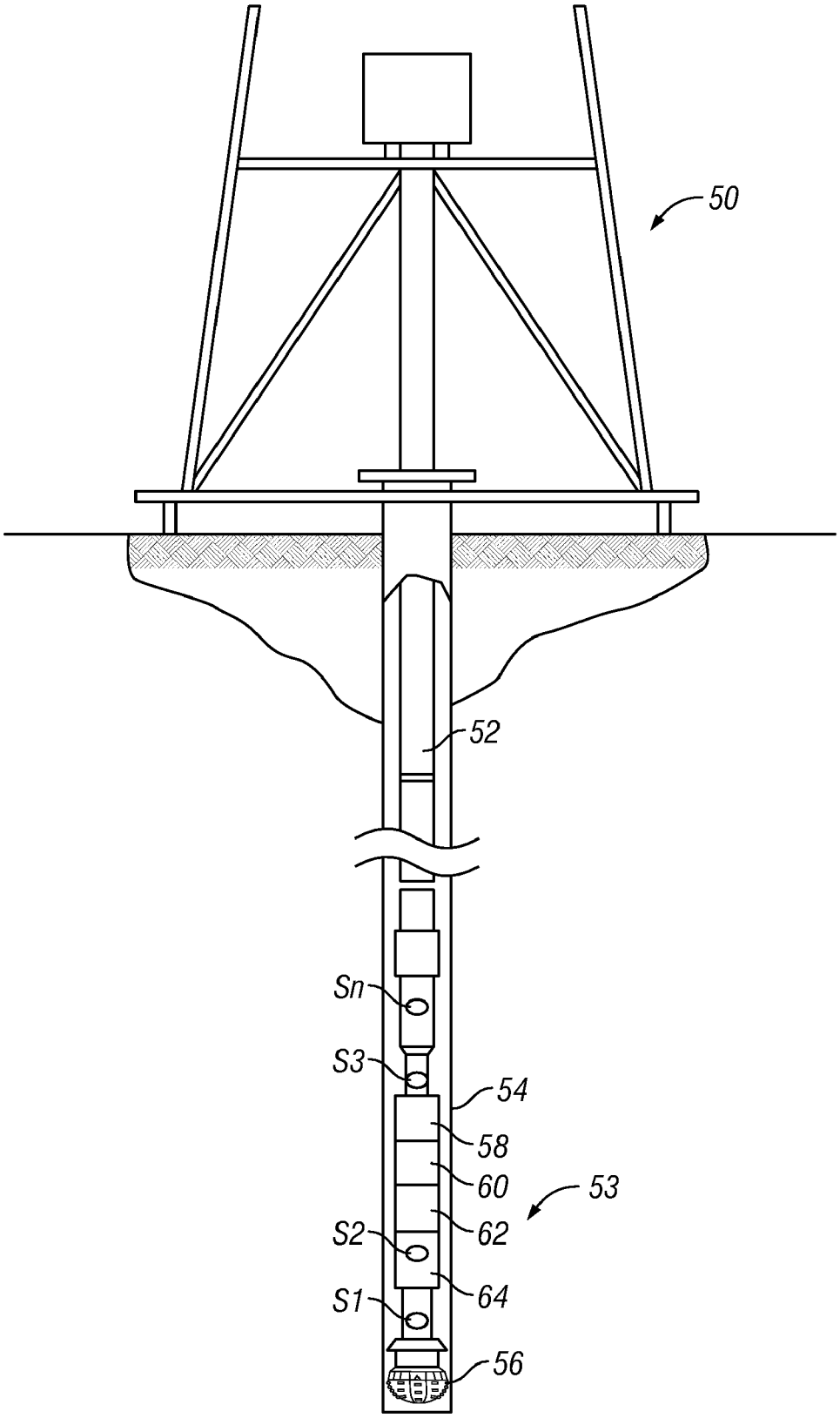
FIG. 2 schematically illustrates an elevation view of a drilling system made according to one embodiment of the present invention.

Referring now to FIG. 2, there is shown a drilling system including a conventional surface rig 50 that conveys a drill string 52 and a bottomhole assembly (BHA) 53 into a wellbore 54 in a conventional manner. The BHA 53 includes a drill bit 56 for forming the wellbore 54 as well as other known devices such as drilling motors, steering units, and formation evaluation tools. Depending on the application, the device for providing rotary power to the drill bit 56 can be the drill string 52, a drilling motor (not shown), or a combination of these devices. A number of arrangements can be used to create oscillations (hereafter "optimizing bit cutting action oscillations" or "optimizing oscillations") that enhance the cutting action of the drill bit 56.

In some arrangements, a system for providing the optimizing oscillations can include a sensor package 58 for measuring one or more parameters of interest (e.g., rate of penetration, rotational speed, weight-on-bit, torsional oscillation, etc.), a control unit 60 for determining an optimizing frequency based, in part, on the sensor measurements, and an oscillation device 62. The sensor package 58 can include one or more sensors S1, S2, S3 . . . Sn distributed in and along the drill string. The measurement of these sensors can be used to determine parameters such as the frequency and amplitude of the oscillations that optimizes the drill bit cutting action (or the "optimizing frequency"). For instance, the sensors S1-n and control unit 60 can initially sweep a range of frequencies while monitoring a key drilling efficiency parameter such as ROP. The oscillation device 62 can then be controlled to provide oscillations at an optimum frequency until the next frequency sweep is conducted. Periodicity of the frequency sweep can be based on a one or more elements of the drilling operation such as a change in formation, a change in measured ROP, a predetermined time period or instruction from the surface. As noted earlier, the term "optimizing" is used to with referenced to a drill bit operating without applied controlled oscillations.

The control unit 60 can include a downhole processor and/or the surface processor. The processor(s) can be microprocessor that use a computer program implemented on a suitable machine readable medium that enables the processor to perform the control and processing. The machine readable medium may include ROMs, EPROMs, EAROMs, Flash Memories and Optical disks. Other equipment such as power and data buses, power supplies, and the like will be apparent to one skilled in the art.

In one embodiment, an oscillation device 62 controls behavior of the drill bit 56 by allowing only selected vibrations in the drill string and/or BHA 53 to reach the drill bit 56. As is known, the drill string 52, in addition to its ordinary rotation, can vibrate in different planes (e.g., torsionally, axially, laterally), frequencies and amplitudes. In one embodiment, the control unit 60, using one or more processors programmed with algorithms, calculates or otherwise determines which of the existing vibrations in the drill string will optimize the cutting action of the drill bit 56 (i.e., the optimizing oscillation). The control unit 60 can make this determination based on the measurement(s) of the sensor package 58, stored data, and/or dynamically updated information. Based on this determination, the oscillation device 62 is configured to isolate and pass through the optimizing frequency to the drill bit 56. For example, the oscillation device 62 can include a filter-type arrangement that permits only an optimizing oscillation of a drill string vibration or oscillation to pass through to the drill bit 56.

In another embodiment, the oscillation device 62 includes a drive unit 64. This drive unit 64 can be used to amplify an optimizing frequency and/or shift an existing frequency to a optimizing frequency. Thus, an existing drill string vibration or oscillation is conditioned (e.g., amplified or shifted) to provide an optimizing oscillation. For example, if the desired torsional resonance (i.e., optimizing oscillation) is not present in the drill string, then the selected frequency could be used to transform an existing torsional oscillation into the optimizing frequency range. This filtering arrangement can be controllable or adjustable to allow changing the optimizing frequency. The drive unit 64 can be energized using a drill fluid pressure drop, electric energy generated by a downhole generator, a cable providing electrical energy from the surface, or suitable downhole or surface power source.

Figure 3:
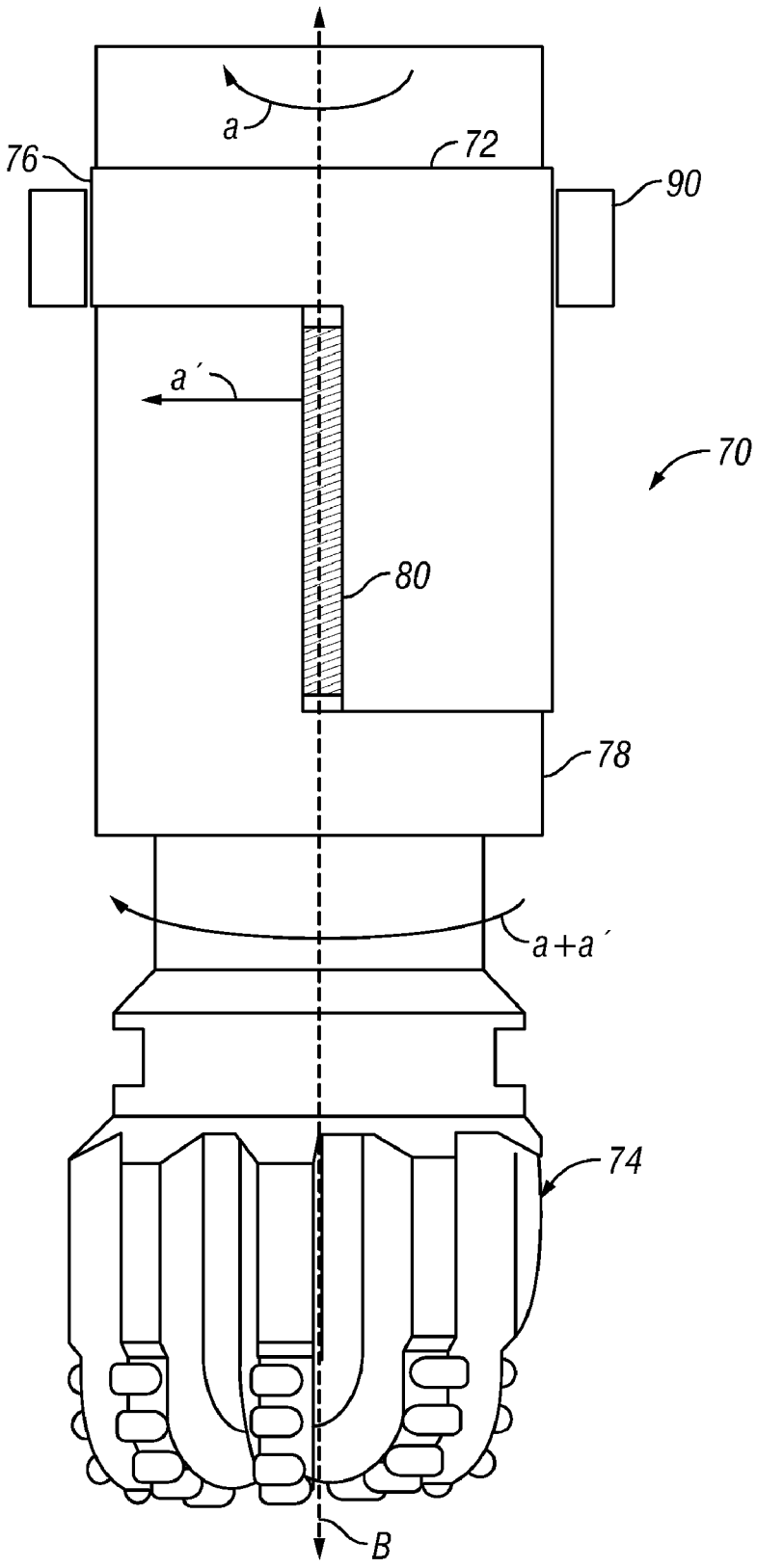
FIG. 3 shows an oscillation device for controlling a drill bit made according to one embodiment of the present invention.

Referring now to FIG. 3, there is shown another embodiment of the present invention wherein the oscillation device 70 is placed in the drill string 72 proximate to the drill bit 74 to create a force or forces that produce the optimizing bit oscillation. In one arrangement, the oscillation device 70 is positioned in a sub 72 run in a near bit location or constructed directly into the drill bit 74. The sub includes an upper section 76 coupled to the drill string 72 and a lower section 78 coupled to the drill bit 74. A controllable element 80 connects the upper and lower sections 76, 78. The upper section 76 and the lower section 78 rotate around a tool line axis B in a manner described below. When energized, the element 80 can momentarily increase the rotational speed of section 78, the change in speed being denoted by a'. During operation, the drill string 72 is rotated at a speed a, which is also the nominal speed of rotation of the drill bit 74 because of the fixed relationship between the upper and lower sections 76, 78. Energizing the element 80 momentarily increases the drill bit speed to a+a'. Thus, cyclically energizing the element 80 can provide a torsional oscillation to the drill bit 74. In some embodiments, the mass of the drill string will provide a sufficient amount of reaction mass to prevent the oscillations from being transferred to the drill string. In other embodiments, a torsion resistance device 90 is positioned on the upper section 76 to prevent the oscillations from being transferred to the drill string 72 rather than the drill bit 74. The torsion resistance device 90 can include equipment such as subs or collars that supplement the inertia of the BHA above the oscillation device 70 relative to the BHA below the oscillation device 90. The torsion resistance device 90 can also include a sleeve or centralizer that engages the borehole wall to resist counter-rotation of the drill string such as by a slip clutch arrangement.

The controllable element 80 can be formed of one or more materials having properties (volume, shape, deflection, elasticity, etc.) that in response to an excitation or control signal produce controlled oscillations in the required frequency range. Suitable materials include, but are not limited to, electrorheological material that are responsive to electrical current, magnetorheological fluids that are responsive to a magnetic field, and piezoelectric materials that responsive to an electrical current. This change can be a change in dimension, size, shape, viscosity, or other material property. Additionally, the material is formulated to exhibit the change within milliseconds of being subjected to the excitation signal/field. Thus, in response to a given command signal, the requisite field/signal production and corresponding material property can occur within a few milliseconds. Thus, hundreds of command signals can be issued in, for instance, one minute. Accordingly, command signals can be issued at a frequency in the range of rotational speeds of conventional drill strings (i.e., several hundred RPM).

Figure 4:
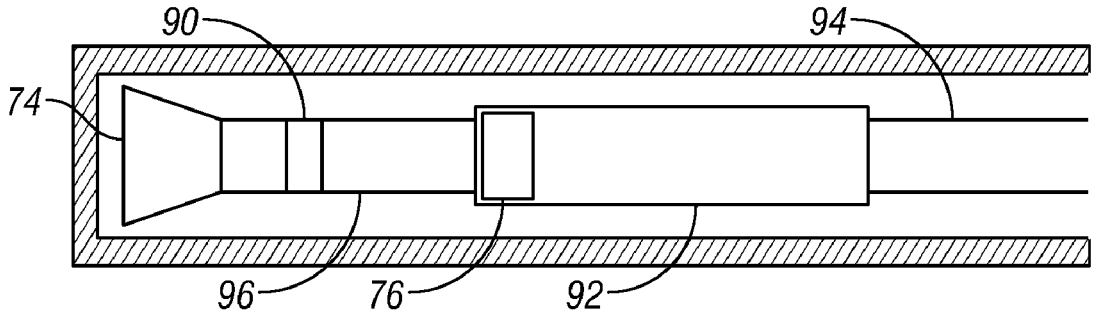
FIG. 4 shows a torque resistance device bit made according to one embodiment of the present invention that is used in connection with a drill bit rotated by a drilling motor.

Referring now to FIG. 4, in some arrangements the drill bit 74 is driven by a drilling motor 92 that connected to the surface via a coiled tubing 94. A shaft assembly 96 transfers rotary power from the drilling motor 92 to the drill bit 74. The oscillation device 90 can be positioned in the shaft assembly 96 to provide controlled oscillations to the drill bit 74. The shaft assembly 96 may not have sufficient mass to prevent the oscillations from being transferred to the portion of the shaft assembly 96 uphole of the oscillation device 90. Thus, the torsion resistance device 76 can be incorporated into the drilling motor 92 or connected to the shaft assembly 96 (e.g., as a mass acting as a torsional or axial anchor or anvil).

Figure 5:
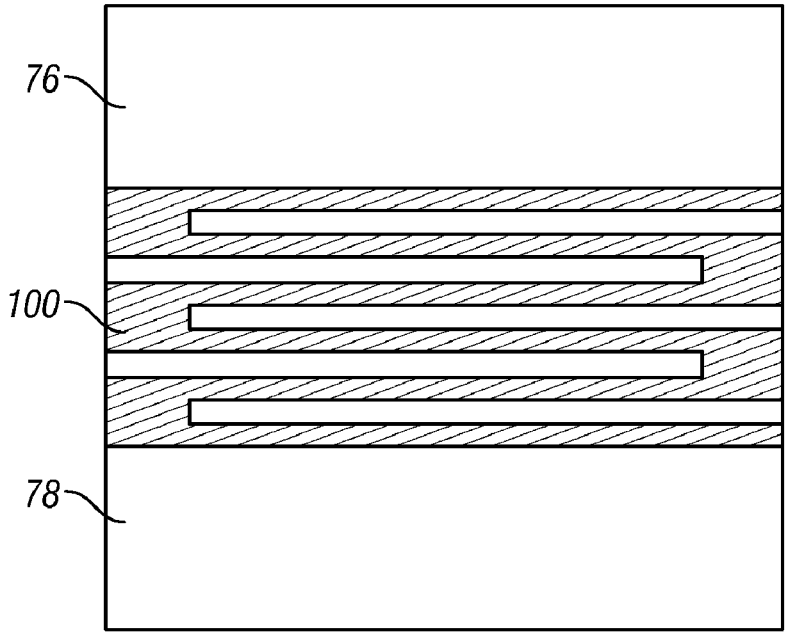
FIG. 5 shows an oscillation device according to one embodiment of the present invention that is positioned in a drill string.

Referring now to FIG. 5, in another embodiment, the upper and lower sections 76, 78 are coupled with an element 100 that normally allow a controlled slippage between sections 76 and 78 and thus the drill string and the drill bit. The element 100 can be formed of a controllable fluid or material that undergoes a change in material property such as viscosity in response to a control signal. In one arrangement, the element 100 normally has a viscosity selected to drive section 78 at a rotational speed lower than section 76. For instance, due to slippage, section 78 rotates at 98 RPM whereas section 76 rotates at 100 RPM. In response to an excitation or command signal, the viscosity of element 100 increases and effectively locks section 78 to section 76. The rotational speed of section 78 then increases to approximately that of section 76 or some intermediate rotational speed. Thus, cycling the excitation signals at the appropriate frequency, a torsional oscillation is applied to drill bit 74.

In still other embodiments, the oscillation device can be positioned within one or more devices forming a bottomhole assembly (BHA). For example, a bearing and shaft assembly in a drilling motor can be modified to provide a controlled oscillation to a shaft connected to the drill bit. Also, in embodiments where an electric drilling motor is used, a control unit associated with the electric drilling motor can be used modulate the rotation of the shaft driving the drill bit.

In still other embodiments, the teachings of the present invention can be advantageously applied to cutters such as under-reamers and hole openers in addition to drill bits.

Figure 6A:
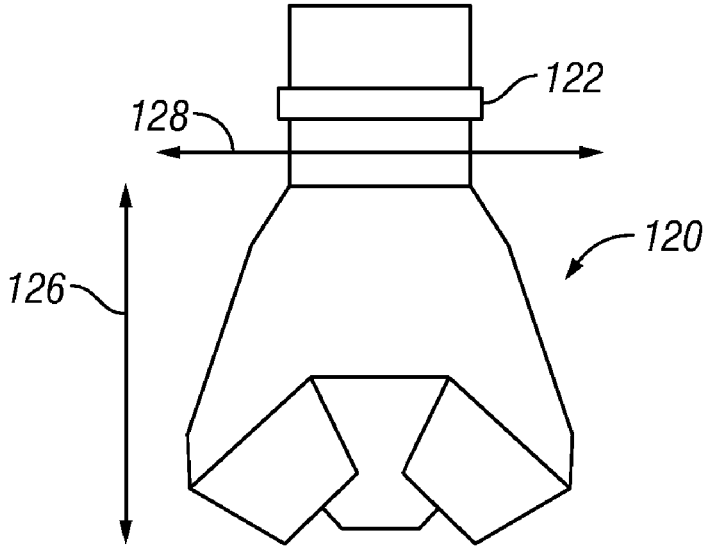
FIG. 6A shows an oscillation device made according to one embodiment of the present invention that is positioned in a drill bit.
Figure 6B:
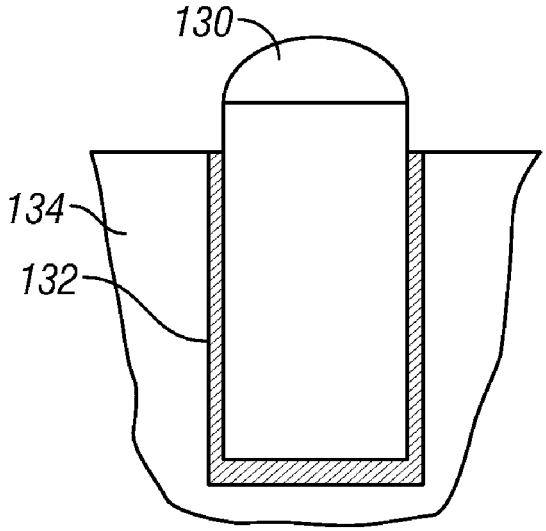
FIG. 6B shows an oscillation device made according to one embodiment of the present invention that is positioned adjacent a cutting element.

In still other embodiments, a drill bit can be modified to provide controlled oscillations to the cutting elements of the drill bit. Referring now to FIG. 6A, there is shown a roller cone drill bit 120 in which is disposed an oscillation device 122. The oscillation device 122, when activated, provides controlled oscillations to the drill bit 120. Exemplary directions of oscillation applied to the drill bit 120 include axial 126 and torsional oscillation 128 as well as lateral (not shown). Referring now to FIG. 6B, there is shown a cutting element 130 connected to an oscillation device 132. The cutting element 130 and oscillation device 132 are fixed in a bit body 134. When activated, the oscillation device 132 temporarily accelerates the cutting element 130 in one or more selected directions. The oscillation device 132 can be used for all or less than all of the cutting elements in a drill bit. Moreover, each such oscillation device can be adapted to operate independently. The oscillation devices of FIGS. 6A and 6B can include controllable elements previously described and suitable processing devices or be coupled to processing devices uphole of the drill bit through telemetry devices such as short hop transmitters.

It should also be understood that the teaching of the present invention can also be applied to devices and methods that do not utilize controllable materials. For example, suitable oscillations can be generated by mechanical, electromechanical, hydro-mechanical, or electrical devices. Merely by way of example, such devices include elastic elements having natural oscillation frequency and amplitude is at the required state, torque tubes, torsional cages, torsional release devices (slip clutches), a torsional sub with slip clutch torque control, axial hammers, etc.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

The invention claimed is:

1. An apparatus for controlling at least one cutting element used to form a wellbore in a subterranean formation, comprising:

at least one cutting element on a drill bit for forming a wellbore in an earthen formation, the drill bit having a constant rotational speed;

an oscillation device oscillating the at least one cutting element; and a control unit coupled to the oscillation device, the control unit configured to process data and provide a signal to control the oscillation device, the signal causing the oscillation device to accelerate the at least one cutting element to at least maintain contact between the at least one cutting element and the formation.

2. The apparatus according to claim 1, wherein the control unit is configured to operate the oscillation device over a specified range of oscillation frequencies.

3. The apparatus according to claim 2, wherein the control unit includes a processor programmed with instructions for determining an optimal oscillation based on data received from at least one sensor.

4. The apparatus according to claim 1, wherein the control unit is configured to (i) operate the oscillation device over a range of oscillation frequencies while receiving data from at least one sensor, and (ii) select an oscillation frequency for the oscillation device based on data received from the at least one sensor.

5. The apparatus according to claim 4, wherein the at least one sensor comprises a plurality of sensors distributed along a drill string on which the at least one cutting element is disposed.

6. The apparatus according to claim 1, wherein the oscillation device accelerates the at least one cutting element in a forward direction and returns the at least one cutting element to no further than a neutral position.

7. The apparatus according to claim 1, wherein the oscillation device is configured to transmit a selected vibration to the at least one cutting element, the selected vibration being present in one of (i) a drill string rotating the at least one cutting element, and (ii) a bottomhole assembly coupled to the at least one cutting element.

8. The apparatus according to claim 1, wherein the oscillation device is positioned at one of (i) along a drill string, (ii) at a bottomhole assembly coupled to the at least one cutting element; and (iii) a body of the drill bit having the at least one cutting element.

9. A method for controlling at least one cutting element used to form a wellbore in a subterranean formation, comprising:

forming a wellbore in an earthen formation using the at least one cutting element formed on a drill bit;

rotating the drill bit at a constant rotational speed;

oscillating the at least one cutting element using an oscillation device;

coupling a control unit to the oscillation device, the control unit configured to process data; and controlling the oscillation device using a signal from the control unit, the signal causing the oscillation device to accelerate the at least one cutting element to at least maintain contact between the at least one cutting element and the formation.

10. The method according to claim 9, further comprising operating the oscillation device over a specified range of oscillation frequencies.

11. The method according to claim 10, further comprising determining an optimal oscillation based on data received from at least one sensor.

12. The method according to claim 9, further comprising operating the oscillation device over a range of oscillation frequencies while receiving data from at least one sensor, and selecting an oscillation frequency for the oscillation device based on data received from the at least one sensor.

13. The method according to claim 12, wherein the at least one sensor comprises a plurality of sensors distributed along a drill string on which the at least one cutting element is disposed.

14. The method according to claim 9, further comprising accelerating the at least one cutting element in a forward direction and returning the at least one cutting element to no further than a neutral position.

15. The method according to claim 9, further comprising transmitting a selected vibration to the at least one cutting element, the selected vibration being present in one of (i) a drill string rotating the at least one cutting element, and (ii) a bottomhole assembly coupled to the at least one cutting element.

16. The method according to claim 9, further comprising positioning the oscillation device at one of (i) along a drill string, (ii) at a bottomhole assembly coupled to the at least one cutting element; and (iii) a body of a drill bit having the at least one cutting element.

17. A system for forming a subterranean wellbore, comprising:

a rig positioned at a surface location;

a drill string conveying a bottomhole assembly into the wellbore from the rig;

a drill bit provided in the bottomhole assembly, the drill bit having at least one cutting element for forming a wellbore in an earthen formation;

an oscillation device oscillating the at least one cutting element; and a control unit coupled to the oscillation device, the control unit configured to process data and provide a signal to control the oscillation device, the signal causing the oscillation device to accelerate the at least one cutting element to at least maintain contact between the at least one cutting element and the formation.

18. The system according to claim 17, wherein the control unit is configured to operate the oscillation device over a specified range of oscillation frequencies.

19. The system according to claim 17, further comprising at least one sensor positioned along the drill string, and wherein the control unit includes a processor programmed with instructions for determining an optimal oscillation based on data received from the at least one sensor.

20. The apparatus according to claim 19, wherein the control unit is configured to operate the oscillation device over a range of oscillation frequencies while receiving data from the at least one sensor.

21. The system according to claim 17, wherein the oscillation device is configured to transmit a selected vibration to the at least one cutting element, the selected vibration being present in one of (i) a drill string rotating the at least one cutting element, and (ii) a bottomhole assembly coupled to the at least one cutting element.

22. The system according to claim 17, wherein the oscillation device is positioned at one of (i) along the drill string, (ii) at the bottomhole assembly, and (iii) in the drill bit.

* * * * *